US011592244B2

(12) United States Patent
Leffler et al.

(10) Patent No.: US 11,592,244 B2
(45) Date of Patent: Feb. 28, 2023

(54) MULTIPORT FLUID DISTRIBUTOR AND MICROCHANNEL HEAT EXCHANGER HAVING THE SAME

(71) Applicant: Carrier Corporation, Palm Beach Gardens, FL (US)

(72) Inventors: Robert A. Leffler, Boston, MA (US); Thomas Bryant, Brewerton, NY (US); Kevin Mercer, Indianapolis, IN (US); Arindom Joardar, Jamesville, NY (US); Tobias H. Sienel, Baldwinsville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 206 days.

(21) Appl. No.: 17/248,783

(22) Filed: Feb. 8, 2021

(65) Prior Publication Data

US 2021/0262744 A1 Aug. 26, 2021

Related U.S. Application Data

(60) Provisional application No. 62/978,935, filed on Feb. 20, 2020, provisional application No. 62/706,028, filed on Jul. 28, 2020.

(51) Int. Cl.

| | |
|---|---|
| ***F28F 9/02*** | (2006.01) |
| ***F25B 39/00*** | (2006.01) |
| ***F25B 39/02*** | (2006.01) |

(52) U.S. Cl.
CPC ..... *F28F 9/028* (2013.01); *F25B 39/00* (2013.01); *F25B 39/028* (2013.01)

(58) Field of Classification Search
CPC ..... F28F 9/028; F28F 1/022; F28F 9/0273; F28F 9/02; F28F 1/126; F25B 39/028; F25B 39/00; F25B 39/04; F28D 1/05366
See application file for complete search history.

(56) References Cited

U.S. PATENT DOCUMENTS 10,132,537 B1 * 11/2018 Stamp ..... F25B 39/028

FOREIGN PATENT DOCUMENTS

WO 20030846921 10/2003

* cited by examiner

*Primary Examiner* — Henry T Crenshaw
*Assistant Examiner* — Kamran Tavakoldavani
(74) *Attorney, Agent, or Firm* — Souad Hakim

(57) ABSTRACT

Disclosed is a multiport distributor comprising: an elongated member comprising a plurality of inlet ports disposed along a first end of the elongated member, a plurality of first outlet ports disposed along a face of the elongated member, and a plurality of fluid passages disposed within the elongated member and extending between the plurality of inlet ports and the plurality of first outlet ports, wherein the plurality of fluid passages are substantially parallel to one another and configured to convey a fluid in a first direction, wherein the plurality of first outlet ports are configured to direct a fluid passing therethrough in a second direction, wherein the second direction is substantially perpendicular to the first direction.

27 Claims, 12 Drawing Sheets

MULTIPORT FLUID DISTRIBUTOR AND MICROCHANNEL HEAT EXCHANGER HAVING THE SAME

CROSS REFERENCE TO A RELATED APPLICATION

The application claims the benefit of U.S. Provisional Application No. 62/978,935 filed Feb. 20, 2020, and U.S. Provisional Application No. 62/706,028 filed Jul. 28, 2020 the contents of which are hereby incorporated.

BACKGROUND

Exemplary embodiments pertain to the art of heat transfer systems. More particularly, the present disclosure relates to configurations of a fluid distributor for microchannel heat exchanger systems.

Microchannel heat exchanger performance can be highly dependent on refrigerant distribution through the microchannel heat exchanger core. Good refrigerant flow distribution can increase heat exchanger effectiveness, and accordingly lower heat exchanger cost. Furthermore, codes and standards, being adopting globally can impose more stringent regulations regarding the amount and type of refrigerants permissible for use in HVAC and refrigeration applications. This can pose additional challenges in adequately distributing the limited amount of refrigerant in a microchannel heat exchanger. Therefore, there remains a need for fluid distributors capable of providing good fluid distribution in microchannel heat exchangers.

BRIEF DESCRIPTION

Disclosed is a multiport distributor comprising: an elongated member comprising; a plurality of inlet ports disposed along a first end of the elongated member, a plurality of first outlet ports disposed along a face of the elongated member, and a plurality of fluid passages disposed within the elongated member and extending between the plurality of inlet ports and the plurality of first outlet ports, wherein the plurality of fluid passages are substantially parallel to one another and configured to convey a fluid in a first direction, wherein the plurality of first outlet ports are configured to direct the fluid passing therethrough in a second direction, wherein the second direction is substantially perpendicular to the first direction.

In addition to one or more of the above disclosed aspects or as an alternate wherein the elongated member comprises a flat tube and the plurality of fluid passages are arranged in a single row within the flat tube.

In addition to one or more of the above disclosed aspects or as an alternate further comprising an inner fluid passage.

In addition to one or more of the above disclosed aspects or as an alternate further comprising an inlet distributor configured to guide the fluid flowing in the first direction into the plurality of inlet ports of the multiport distributor.

In addition to one or more of the above disclosed aspects or as an alternate further comprising an inlet distributor configured to guide the fluid flowing in the first direction into the plurality of inlet ports of the multiport distributor, wherein the inlet distributor comprises a neck, and wherein the neck is configured to slidable fit into the inner fluid passage.

In addition to one or more of the above disclosed aspects or as an alternate further comprising an inner hole disposed in a wall of the inner fluid passage.

In addition to one or more of the above disclosed aspects or as an alternate further comprising two or more inner holes disposed in a wall of the inner fluid passage, the two or more inner holes and the inner fluid passage forming a fluid passageway configured to convey the fluid in a third direction, and wherein the third direction is substantially opposite the first direction.

In addition to one or more of the above disclosed aspects or as an alternate further comprising a plurality of inner holes disposed in a wall of the inner fluid passage along a length of the multiport distributor, wherein at least two inner holes of the plurality of inner holes are in fluid communication with otherwise fluidly separate fluid passages, and wherein the at least two inner holes and the inner fluid passage form a fluid passageway configured to convey the fluid in a third direction, and wherein the third direction is substantially opposite the first direction.

In addition to one or more of the above disclosed aspects or as an alternate wherein one or more passages of the plurality of fluid passages comprises a cross-sectional flow area that is greater than the cross sectional flow area of the remaining passages.

In addition to one or more of the above disclosed aspects or as an alternate wherein two or more of the plurality of first outlet ports are disposed in fluid communication with one of the plurality of fluid passages In addition to one or more of the above disclosed aspects or as an alternate wherein the number of outlet ports in the plurality of first outlet ports is greater than the number of inlet ports in the plurality of inlet ports.

In addition to one or more of the above disclosed aspects or as an alternate wherein one of the first outlet ports is disposed in fluid communication with two or more of the plurality of fluid passages.

In addition to one or more of the above disclosed aspects or as an alternate wherein the number of outlet ports in the plurality of first outlet ports is less than the number of inlet ports in the plurality of inlet ports.

In addition to one or more of the above disclosed aspects or as an alternate wherein one or more outlet ports of the plurality of outlet ports comprises a hydraulic diameter that is greater than the hydraulic diameter of the remaining outlet ports.

In addition to one or more of the above disclosed aspects or as an alternate wherein an outlet port of the plurality of first outlet ports is disposed in fluid communication through the elongated member with only one inlet port of the plurality of inlet ports and only one fluid passage of the plurality of fluid passages, and wherein the outlet port, the fluid passage, and the inlet port all each comprise a hydraulic diameter that is substantially equal.

In addition to one or more of the above disclosed aspects or as an alternate further comprising a plurality of second outlet ports disposed along an end opposite the first end of the elongated member, wherein the plurality of second outlet ports are substantially obstructed to substantially reduce the ability for fluid to flow therethrough.

In addition to one or more of the above disclosed aspects or as an alternate wherein the elongated member comprises an extruded multiport tube.

Further disclosed is a microchannel heat exchanger comprising a first manifold, a second manifold and a plurality of microchannel tubes extending between the first manifold and the second manifold, and the multiport distributor of any of the above disclosed aspects or as an alternate, wherein the multiport distributor is disposed in the first manifold of the microchannel heat exchanger and is configured to distribute a flow of a first heat transfer fluid to the plurality of microchannel tubes.

In addition to one or more of the above disclosed aspects or as an alternate further comprising a separator plate disposed within the first manifold surrounding the multiport distributor and sealed against the first manifold internal walls, wherein the separator plate divides the first manifold internal volume into two volumes.

In addition to one or more of the above disclosed aspects or as an alternate wherein the two volumes comprise a multiport distributor inlet header volume and a microchannel tube inlet header volume, and wherein the multiport distributor inlet header volume is smaller than the microchannel tube inlet header volume.

In addition to one or more of the above disclosed aspects or as an alternate further comprising a conduit in fluid communication with the plurality of the inlet ports of the multiport distributor wherein a first flow direction through the conduit is oriented perpendicular to a flow direction through the plurality of inlet ports of the multiport distributor.

In addition to one or more of the above disclosed aspects or as an alternate wherein the first heat transfer fluid comprises a refrigerant.

In addition to one or more of the above disclosed aspects or as an alternate wherein the first heat transfer fluid comprises a liquid.

In addition to one or more of the above disclosed aspects or as an alternate wherein the multiport distributor is oriented within the first manifold having an orientation angle between an axis of the first outlet ports and an axis of an inlet port of the plurality of microchannel tubes of between 130° and 230°.

In addition to one or more of the above disclosed aspects or as an alternate wherein the plurality of microchannel tubes of the microchannel heat exchanger further comprise a bend to form a V shaped heat exchanger core.

A vapor compression system comprising a microchannel heat exchanger of any one or more of the above disclosed aspects.

Further disclosed is a brazed plate heat exchanger comprising a plurality of stacked contoured plates forming a plurality of flow passages disposed therebetween, each plate comprising a first opening therethrough, wherein the first openings of the plurality of stacked contoured plates are aligned to form a first manifold, and the multiport distributor of any of the above disclosed aspects or as an alternate, wherein the multiport distributor is disposed in the first manifold of the brazed plate heat exchanger and is configured to distribute a flow of a first heat transfer fluid to the plurality of flow passages.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Flow distribution through microchannel heat exchangers can be an important aspect of their design. Flow dead zones and eddies can allow for the formation of hot spots on the heat exchanger core and reduce its overall effectiveness. Challenges maintaining microchannel heat exchanger performance can be exacerbated as global codes and standards continue to drive system refrigerant charge levels down. As regulations require system charge reductions, all parts of the system can be faced with reduced volume to perform their function. Accordingly, reducing the size of a microchannel heat exchanger manifold and distributor can be beneficial to the system.

Figure 1:
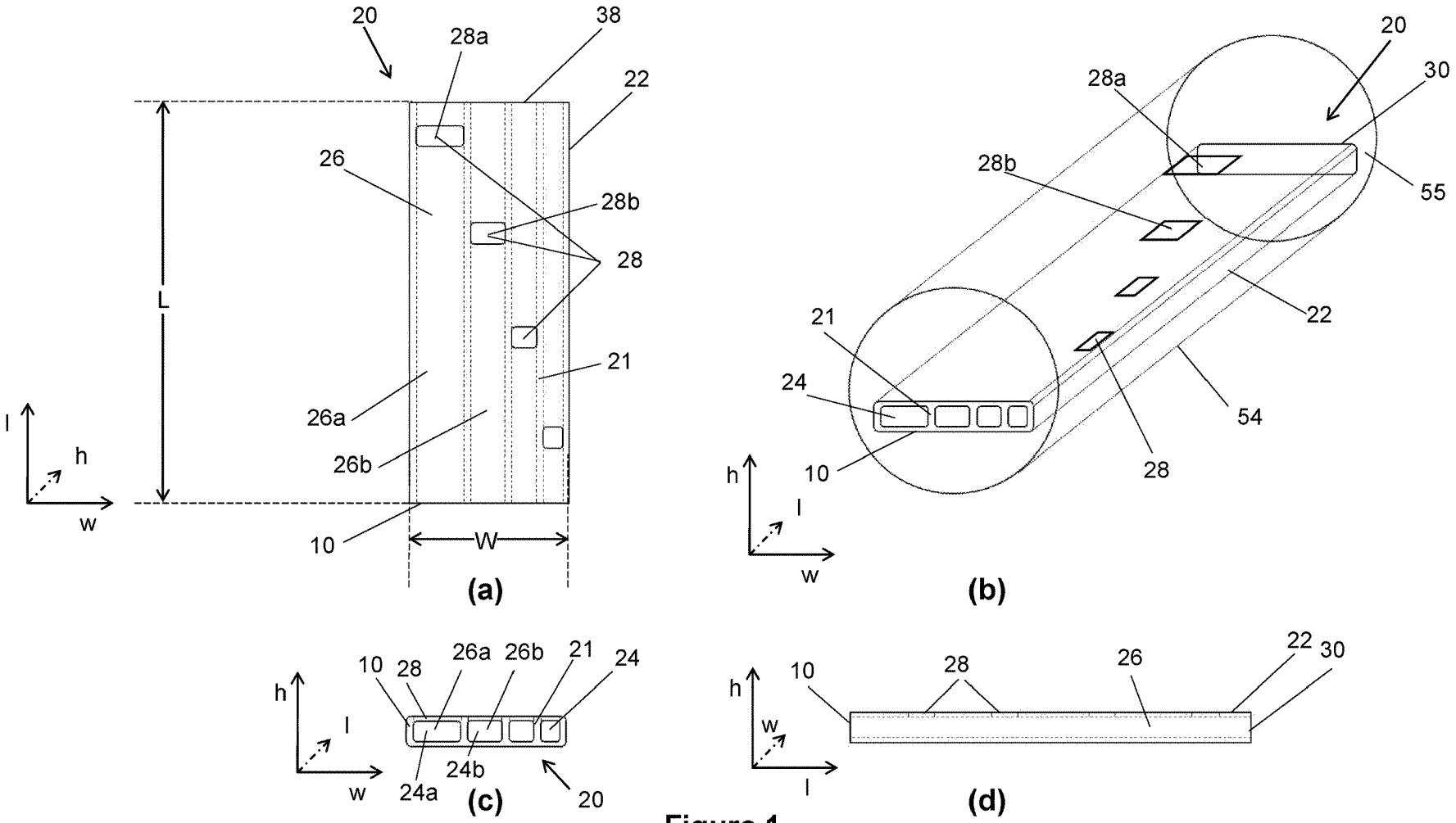
FIG. 1 is a schematic illustration of a face view (a), end view (b), side view (c) and isometric view (d) of a multiport distributor having varied size fluid passages.

FIG. 1 is a schematic illustration of a face view (a), isometric view (b), end view (c) and side view (d) of a multiport distributor 20. The multiport distributor 20 includes an elongated body 22 having a plurality of inlet ports 24 disposed along a first end 10. Further included are a plurality of first outlet ports 28 disposed along a face (e.g., top face or bottom face) of the multiport distributor 20 and a plurality of fluid passages 26 (e.g., shown in dashed lines in the face and side views) extending between the plurality of inlet ports 24 and the plurality of first outlet ports 28. The plurality of fluid passages 26 can be fluidly isolated from one another along the passages, for example by a web 21 disposed between adjacent passages. As shown in the isometric view (d), the multiport distributor 20 can be located in a first manifold 54 of a microchannel heat exchanger.

Figure 2:
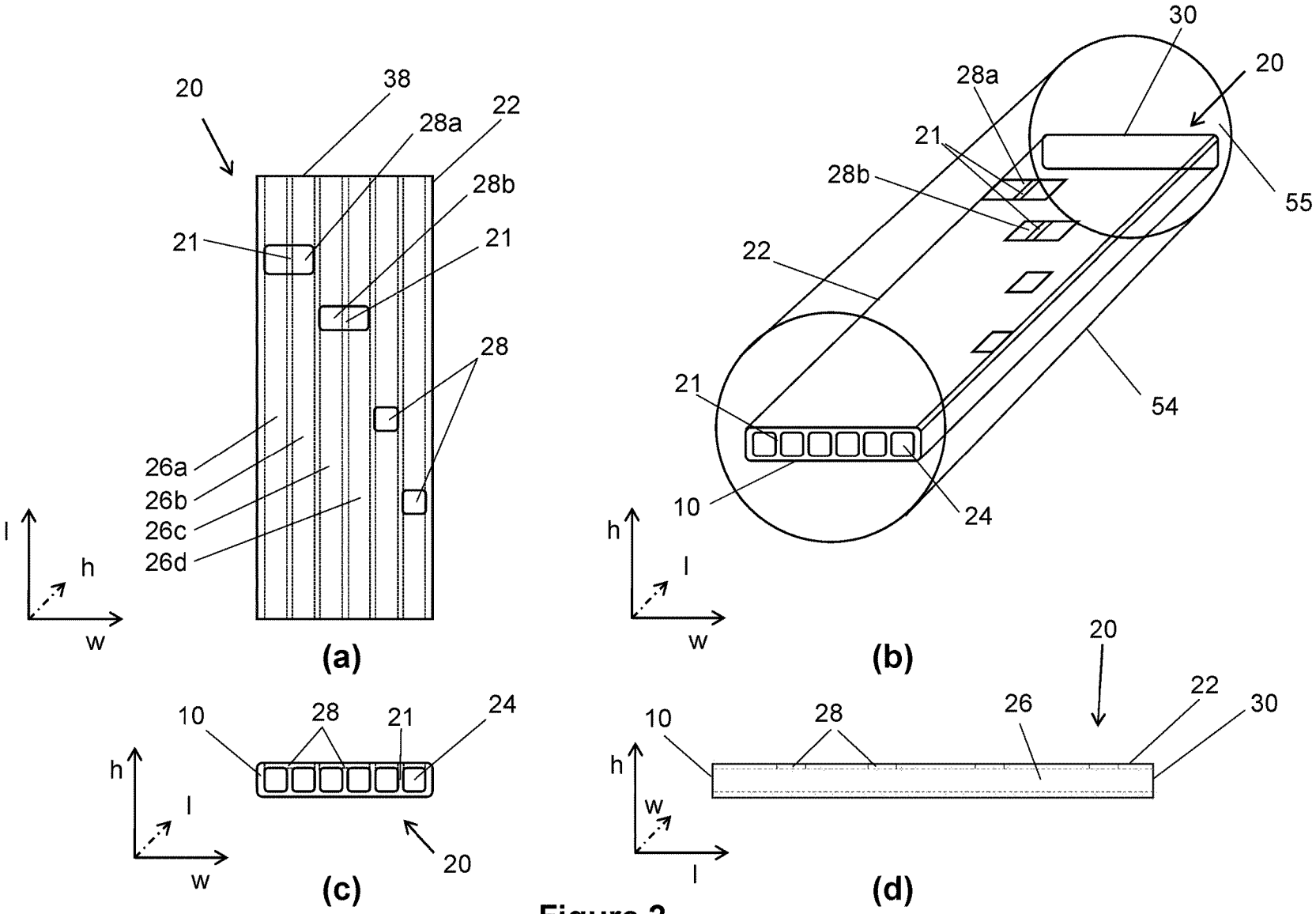
FIG. 2 is a schematic illustration of a face view (a), end view (b), side view (c) and isometric view (d) of a multiport distributor having equally sized fluid passages.

FIG. 2 is a schematic illustration of a face view (a), isometric view (b), end view (c) and side view (d) of a multiport distributor 20. The inlet ports 24 and corresponding fluid passage 26 can be equally spaced and equally sized. Individual ports of the plurality of first outlet ports 28 can span across two or more fluid passages 26. For example, first outlet ports 28*a* and 28*b* of the plurality of first outlet ports 28 can be arranged to span across adjacent fluid passages 26 such that first outlet port 28*a* is configured to merge the flow from fluid passage 26*a* and 26*b* and first outlet port 28*b* is configured to merge the flow from fluid passages 26*c* and 26*d*. In this case, a web 21 can divide the first outlet ports 28. In this example, two outlet ports are configured to merge adjacent fluid passages, however the number of first outlet ports 38 which span adjacent fluid passages, the location of first outlet ports and the distribution of first outlet ports 38 along the face of the multiport distributor 20 can be chosen based on the flow distribution desired. As shown in the isometric view (d), the multiport distributor 20 can be located in a first manifold 54 of a microchannel heat exchanger.

Figure 3:
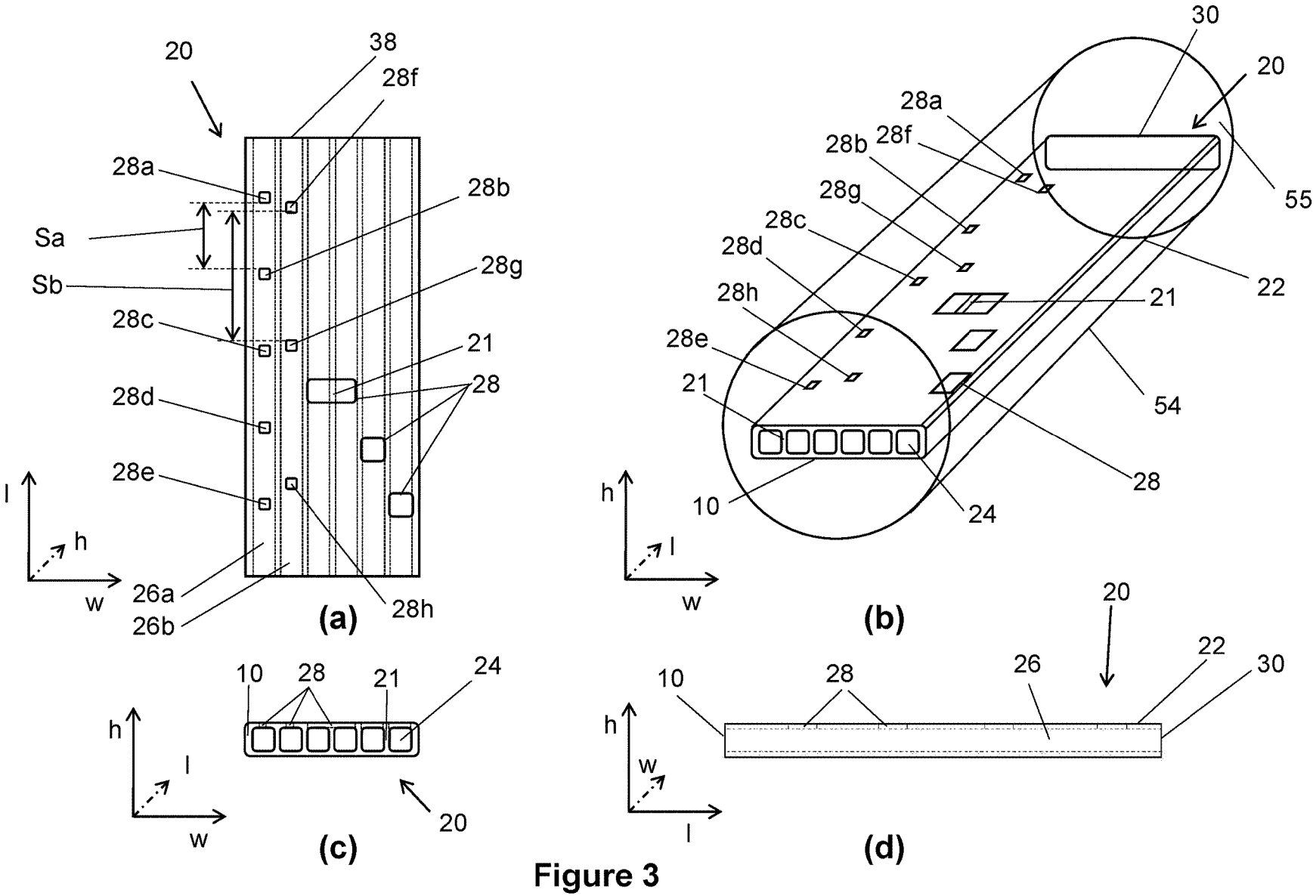
FIG. 3 is a schematic illustration of a face view (a), end view (b), side view (c) and isometric view (d) of a multiport distributor having linearly distributed outlet ports.

FIG. 3 is a schematic illustration of a face view (a), isometric view (b), end view (c) and side view (d) of a multiport distributor 20. The inlet ports 24 and corresponding fluid passage 26 can be equally spaced and equally sized. The first outlet ports 28 can include ports of various hydraulic diameter which are arranged along the face of the multiport distributor 20 in any pattern. The first outlet ports 28 can be arranged in a column (e.g., linearly along the 1-axis dimension), or can be patterned non-linearly along fluid passages 26. The spacing between first outlet ports 28 arranged along a fluid passage 26 (e.g., linearly or non-linearly) can be uniform or can be varied along the length of the fluid passage 26 (e.g., collocating more outlet ports in an area where increased flow is desired). For example, a first set of first outlet ports 28*a*-28*e* can be arranged in a linear pattern along a first fluid passage 26*a* having an equal port spacing Sa. Further, a second set of first outlet ports 28*f*-28*h* can be arranged in a linear pattern along a second fluid passage 26*b* having an equal port spacing of Sb. The port spacing and relative position can be chosen based on the desired flow distribution. As shown in the isometric view (d), the multiport distributor 20 can be located in a first manifold 54 of a microchannel heat exchanger.

The elongated body 22 of the multiport distributor 20 can include a flat tube where the plurality of fluid passages 26 are arranged in a single row. The inlet ports 24 can extend throughout the length L (e.g., measured along the 1-axis dimension in the attached figures) of the multiport distributor 20 to form the corresponding fluid passages 26. For example, the body 22 of the multiport distributor 20 can be formed integrally, such as in an extrusion process (e.g., extruded microchannel heat exchanger tube), a bending/folding process, a forming process, a process involving inserting a web structure into a hollow tube, and the like, or a combination comprising at least one of the foregoing, where the inlet ports 24 and fluid passages 26 are formed together. Configuring the elongated body 22 in this way can reduce the cross-sectional area relative to a round tube distributor making it more compact and beneficial to refrigerant charge reduction initiatives (e.g., allowing for reduced manifold size). In an example, a round tube type distributor, having a single passage with holes distributed down its length can have an outside diameter of 9.5 mm and a corresponding multiport distributor 20 having multiple parallel flow passages can have a height (e.g., extending along the h-axis dimension in the attached figures) of from 1.0 mm to 5.0 mm and a width of 9.5 mm. In this example the round tube distributor would occupy and cross-sectional area 70.9 square millimeters ($mm^2$) versus the multiport distributor 20 which would occupy from 9.5 $mm^2$ to 47.5 $mm^2$—accounting for up to an 86% reduction in cross-sectional area.

The multiport distributor 20 is shown having four inlet ports 24 and four corresponding fluid passages 26 in FIG. 1, and having six inlet ports 24, six corresponding fluid passages 26 in FIGS. 2-3, and sixteen inlet ports 24 and corresponding fluid passages 26 in FIGS. 7-11. However, the multiport distributor 20 can include any suitable number of inlet ports 24 and corresponding fluid passages 26. For example, the multiport distributor 20 can include 2-50 inlet ports 24 and corresponding fluid passages 26, or 2-25 inlet ports 24 and corresponding fluid passages 26, or 2-15 inlet ports 24 and corresponding fluid passages 26, or 10-25 inlet ports 24 and corresponding fluid passages 26, or the like.

The inlet ports 24 and corresponding fluid passages 26 can have any suitable cross-sectional shape and corresponding hydraulic diameter. For example, the cross-sectional shape of any of the inlet ports 24 and corresponding fluid passages 26 can include quadrilateral (e.g., trapezoidal, square, rectangular, and the like), oval, ovoid, circular, triangular, star shaped, a simple polygon having straight or curved sides, or the like. The inlet ports 24 and corresponding fluid passages 26 can have a hydraulic diameter of about 0.1 millimeters (mm) to about 25 mm, or from about 1 mm to about 16 mm, or from about 4 mm to about 14 mm.

The multiport distributor 20 can include any suitable number of first outlet ports 28. For example, the multiport distributor 20 can include 2-1000 first outlet ports 28, or 2-500 first outlet ports 28, or 2-200 first outlet ports 28, or 2-100 first outlet ports 28, or 2-50 first outlet ports 28, or 2-25 first outlet ports 28, or the like. The multiport distributor 20 can have any suitable ratio of the number of first outlet ports 28 to the number of inlet ports 24 and corresponding fluid passages 26. For example, the multiport distributor 20 can have more inlet ports 24 and corresponding fluid passages 26 than first outlet ports 28 such that two or more inlet ports 24 and corresponding fluid passages 26 are merged into a single first outlet port 28. For example, more specifically, the multiport distributor 20 could include a ratio of first outlet ports 28 to inlet ports 24 of 1:10, or 1:9, or 1:8, or 1:7, or 1:6, or 1:5, or 1:4, or 1:3 or, 1:2, or 1:1, or 2:1, or 3:1 or 4:1 or 5:1 or 7:1 or 9:1 or 10:1 or 25:1 or 50:1 or 100:1 or 500:1, or 1000:1, or the like.

The plurality of first outlet ports 28 can be arranged along a face of the multiport distributor 20 (e.g., along a side of the multiport distributor 20 extending coplanar with the w-l plane in the attached figures) in any pattern. For example, the first outlet ports 28 can be disposed in a row (e.g., linearly along the w-axis dimension in the attached figures), in a column (e.g., linearly along the l-axis dimension in the attached figures), or a combination thereof. For example, the first outlet ports 28 can be arranged in a diagonal pattern along the width W and length L of the multiport distributor 20 as shown in FIGS. 1-2. Further, as shown in FIG. 3, the first outlet ports 28 can be arranged in a linear pattern along one or more fluid passages 26 along one portion of the multiport distributor 20 and in a diagonal pattern along another portion of the multiport distributor 20.

Individual ports of the plurality of first outlet ports 28 can have any suitable cross-sectional shape and corresponding hydraulic diameter. For example, the cross-sectional shape of the first outlet ports 28 can include quadrilateral (e.g., trapezoidal, square, rectangular, and the like), oval, ovoid, circular, triangular, star shaped, a simple polygon having straight or curved sides, or the like. The cross-sectional shape of first outlet ports 28 can vary throughout the face of the multiport distributor 20. For example, the hydraulic diameter of first outlet ports 28*a* can be greater than the hydraulic diameter of another first outlet port 28*b*. Further, the hydraulic diameter can be chosen as a function of a fluid path length associated with passing therethrough. For example, larger hydraulic diameter first outlet ports 28 can be disposed in a longer fluid path and smaller hydraulic diameter first outlet ports 28 in a shorter fluid path. The first outlet ports 28 can have a hydraulic diameter of about 0.05 millimeters (mm) to about 25 mm, or from about 0.1 mm to about 16 mm, or from about 0.5 mm to about 14 mm.

Figure 4:
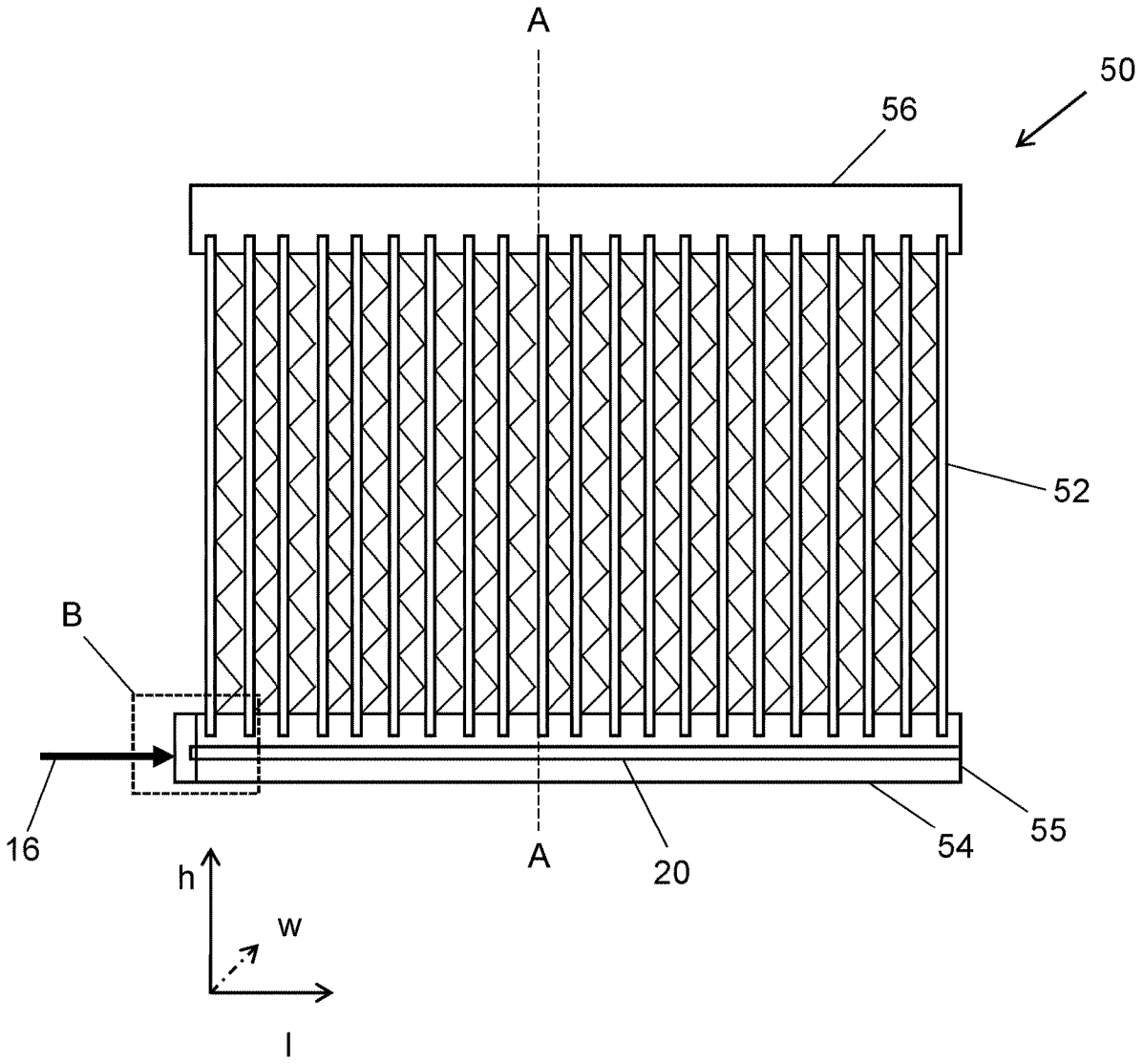
FIG. 4 is a schematic illustration of a microchannel heat exchanger having a multiport distributor disposed in a manifold.
Figure 5:
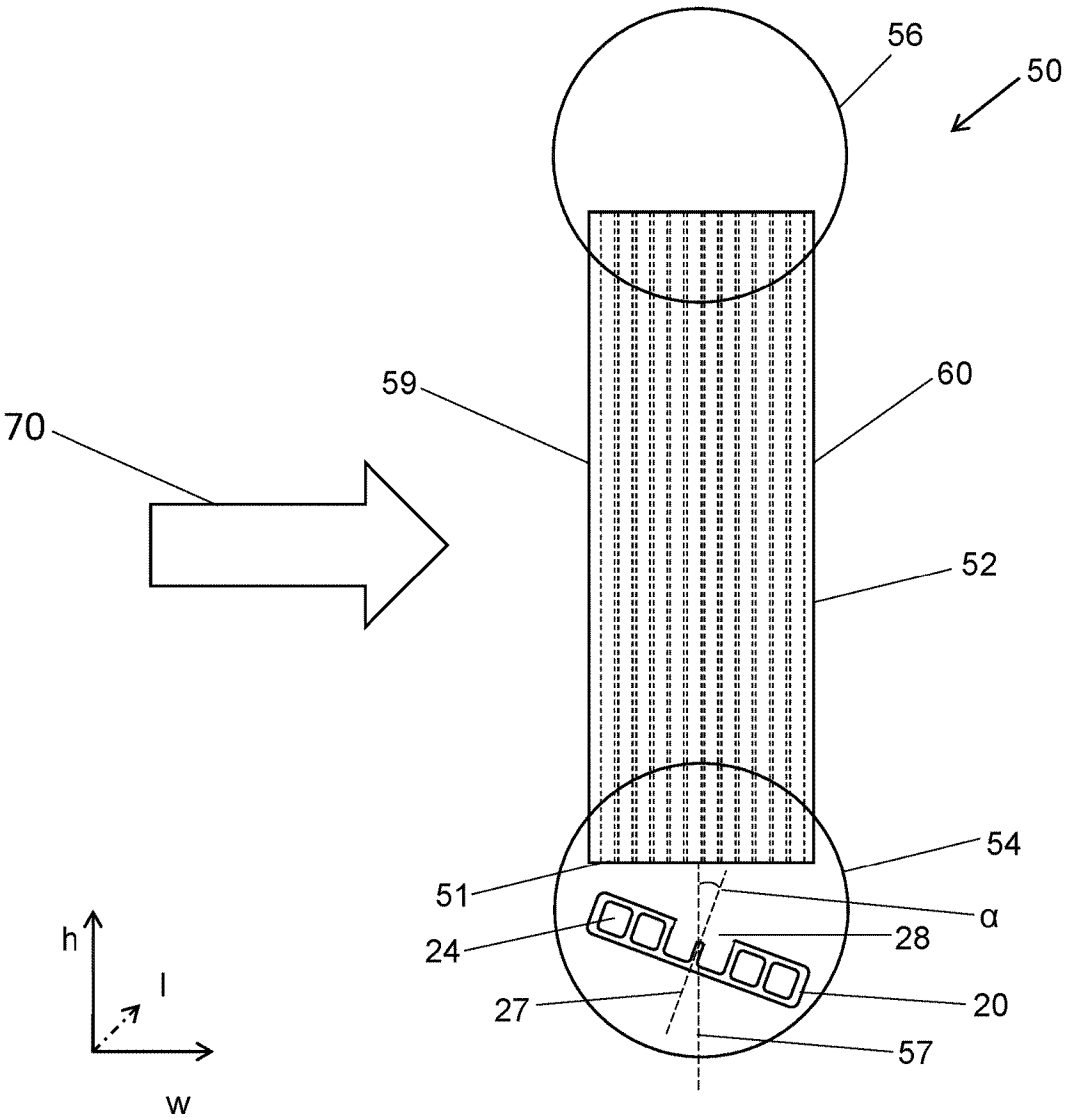
FIG. 5 is a schematic illustration of the A-A cross-section of the microchannel heat exchanger of FIG. 4.
Figure 6:
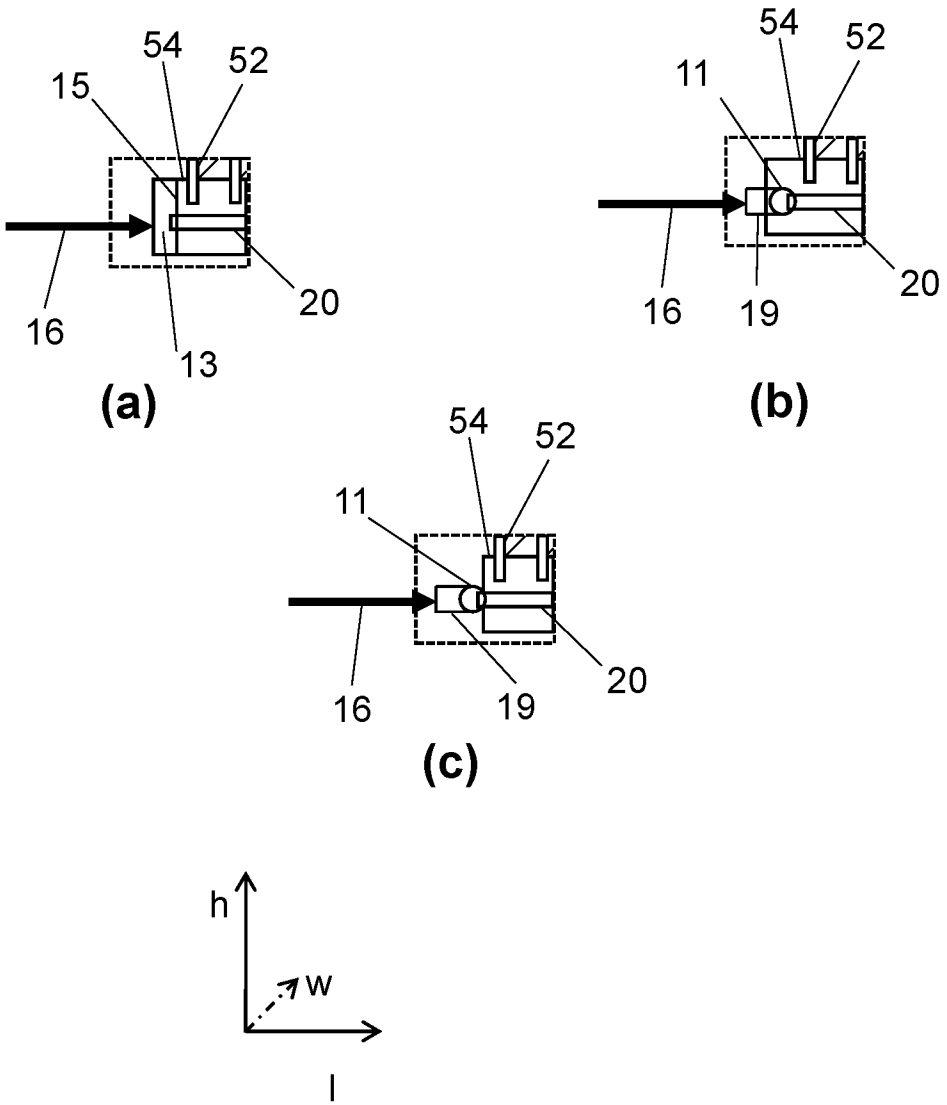
FIG. 6 is a schematic illustration of detail B of the microchannel heat exchanger of FIG. 4.

Turing now to FIGS. 4-6, the multiport distributor 20 can be located in a manifold 54 (e.g., inlet header) of a microchannel heat exchanger 50 in a refrigeration system. For example, the microchannel heat exchanger 50 can function as an evaporator in a vapor compression cycle utilized for air conditioning or refrigeration. In an example, the multiport distributor 20 is disposed in the inlet header of a microchannel heat exchanger 50 evaporator (e.g., furnace coil) of a split system and can be configured to provide a desired distribution of a flow of a first heat transfer fluid to the microchannel tubes 52 therein.

The microchannel heat exchanger 50 can include a plurality of microchannel tubes 52 extending from a side of the first manifold 54 (e.g. inlet manifold) to a second manifold 56 (e.g., outlet manifold). FIG. 5 is a schematic illustration of a portion of a cross sectional view of microchannel heat exchanger 50 taken at the location A-A in FIG. 4. Inside the first manifold 54, the multiport distributor 20 can be oriented based on an orientation angle $\alpha$ between an outlet port axis 27 of the first outlet ports 28 and an inlet port axis 57 of the inlet ports 51 of the plurality of microchannel tubes 52 as shown in FIG. 5 (where the channels of the microchannel tubes are shown in dashed lines). The orientation angle $\alpha$ can be from 0° to 359°, or from 60° to 300°, or from 90° to 270°, or from 130° to 230°, or from 135° to 225° and can be selected based on the desired flow distribution through the plurality of microchannel tubes 52 of the microchannel heat exchanger 50. For example, the multiport distributor 20 can be configured such that the first outlet ports 28 face inlet ports 51 of the plurality microchannel tubes 52, having a 0° angle between an outlet port axis 27 of the first outlet ports 28 and an inlet port axis 57 of the inlet ports 51 of the plurality of microchannel tubes 52. The, multiport distributor 20 can be configured such that the first outlet ports 28 face directly away from inlet ports 51 of the plurality microchannel heat exchanger tubes 52, having a 180° angle between an outlet port axis 27 of the first outlet ports 28 and an inlet port axis 57 of the inlet ports of the plurality of microchannel tubes 52.

FIG. 6 is a schematic illustration of detail B of FIG. 4, where an inlet 16 (e.g., carrying liquid phase refrigerant) is fluidly connected to the multiport distributor 20 at the first manifold 54. As shown in FIG. 6*a*, the inlet 16 can be fluidly connected to the multiport distributor 20 via an inlet volume 13 created using a separator plate 15 disposed within the first manifold between the first manifold inside wall and the multiport distributor 20. Alternative methods of connecting the inlet 16 to the multiport distributor 20 include utilizing a conduit 11 (e.g., round tube) to extend across the plurality of inlet ports 24 (e.g., along the w-axis dimension in the attached figures) to act as a header feeding the multiport distributor 20. The conduit 11 can connect to interconnecting plumbing 19, which can be disposed between the inlet 16 and the conduit 11, and can be disposed inside the first manifold 54 (as in FIG. 6*b*) or outside the first manifold 54 (as in FIG. 6*c*).

The inventors have found that through the use of the multiport distributor 20 the side-to side flow distribution (e.g. w-axis in the attached figures) through the microchannel heat exchanger 50 core can also be adjusted. For example, a first side 59 of the microchannel heat exchanger 50 can have increased flow by increasing the hydraulic diameter of inlet port(s) 24, fluid passage(s) 26, first outlet port(s) 28 or a combination thereof feeding the first side 59. Biasing flow resistance in this way, from side to side, can help improve the effectiveness of the microchannel heat exchanger 50 by allowing for adjustment of the flow rate of a first heat transfer fluid (e.g., refrigerant) through the microchannel heat exchanger 50 core from a leading edge side 59 to a trailing edge side 60 with respect to a flow 70 of a second heat transfer fluid (e.g., air) across the plurality of microchannel tubes 52 of the core of the microchannel heat exchanger 50.

The hydraulic diameter of the inlet ports 24 and corresponding fluid passages 26 can be varied along the width (e.g. along the w-axis dimension in the attached figures) of the multiport distributor 20. The multiport distributor 20 can be configured with larger hydraulic diameter ports where increased flow is desired. For example as shown in FIG. 1, a first inlet port 24*a* and corresponding first fluid passage 26*a* can have a larger hydraulic diameter than a second inlet port 24*b* and corresponding fluid passage 26*b* of the plurality of fluid passages 26. In this way, the first inlet port 24*a* and corresponding first fluid passage 26*a* can convey fluid at a higher rate than the second inlet port 24*b* and corresponding second fluid passage 26*b* under the same boundary conditions.

Another way to bias flow to a side of the multiport distributor 20 can be to increase the number of the first outlet ports 28 (e.g., a second way of increasing the hydraulic diameter of the first outlet port(s) 28), or change the location of first outlet ports 28 such that more are feeding the side.

The multiport distributor 20 can include a plurality of second outlet ports 38 disposed in-line (e.g., coaxial and congruent) with the inlet ports 24, and disposed along a second end 30 of the multiport distributor 20 (e.g., at the end of the multiport distributor 20 opposite from the inlet ports 24). For example, during manufacture of the body 22, second outlets 38 can be formed as a by-product of the process (e.g., extrusion or other methods of forming integrally). If present, the second outlet ports 38 can optionally be substantially obstructed to substantially reduce the ability for fluid to flow therethrough. For example, the second outlet ports 38 can be substantially obstructed by positioning the multiport distributor 20 such that the second outlet ports 38 are substantially obstructed by another object (e.g., a wall of a heat exchanger manifold), a plate can be substantially sealed over second outlet ports 38, the multiport distributor 20 can be crimped, bent, welded, brazed, and/or folded at or near the second end 30, one or more inserts can be placed into second outlet ports 38, and the like, or a combination including at least one of the foregoing can be employed to substantially obstruct second outlet ports 38. In an example, the multiport distributor 20 can be placed within a first manifold 54 of a heat exchanger where the second outlet ports 38 are positioned abutting a wall 55 of the first manifold 54 which can substantially obstruct the second outlet ports 38. The heat exchanger can be brazed after assembly to help further seal between the second outlet ports 38 and an obstruction (e.g., the wall 55, an insert, a plate, and the like).

The first manifold 54 can optionally include baffles (e.g., solid plate, plate with holes, louvers, and the like) for directing flow from the multiport distributor 20 to inlet ports 51 of the plurality of microchannel tubes 52. Such baffles can be positioned within the first manifold 54 relative to the multiport distributor 20 in any way to achieve the desired flow distribution through the plurality of microchannel tubes 52. For example, a baffle can extend along the length or width of the multiport distributor 20 and can extend partially or fully between an internal wall of the first manifold and a surface of the multiport distributor.

As described previously, the plurality of inlet ports 24 and corresponding fluid passages 26 can have any cross-sectional shape (e.g., in the w-h plane) which, correspondingly, can impart any cross-sectional shape to the multiport distributor 20. For example, the inlet ports 24 and corresponding fluid passages 26 can have a pie shaped cross-sectional shape configured to give the multiport distributor 20 a circular cross-sectional shape as shown in FIGS. 7-11.

Figure 7:
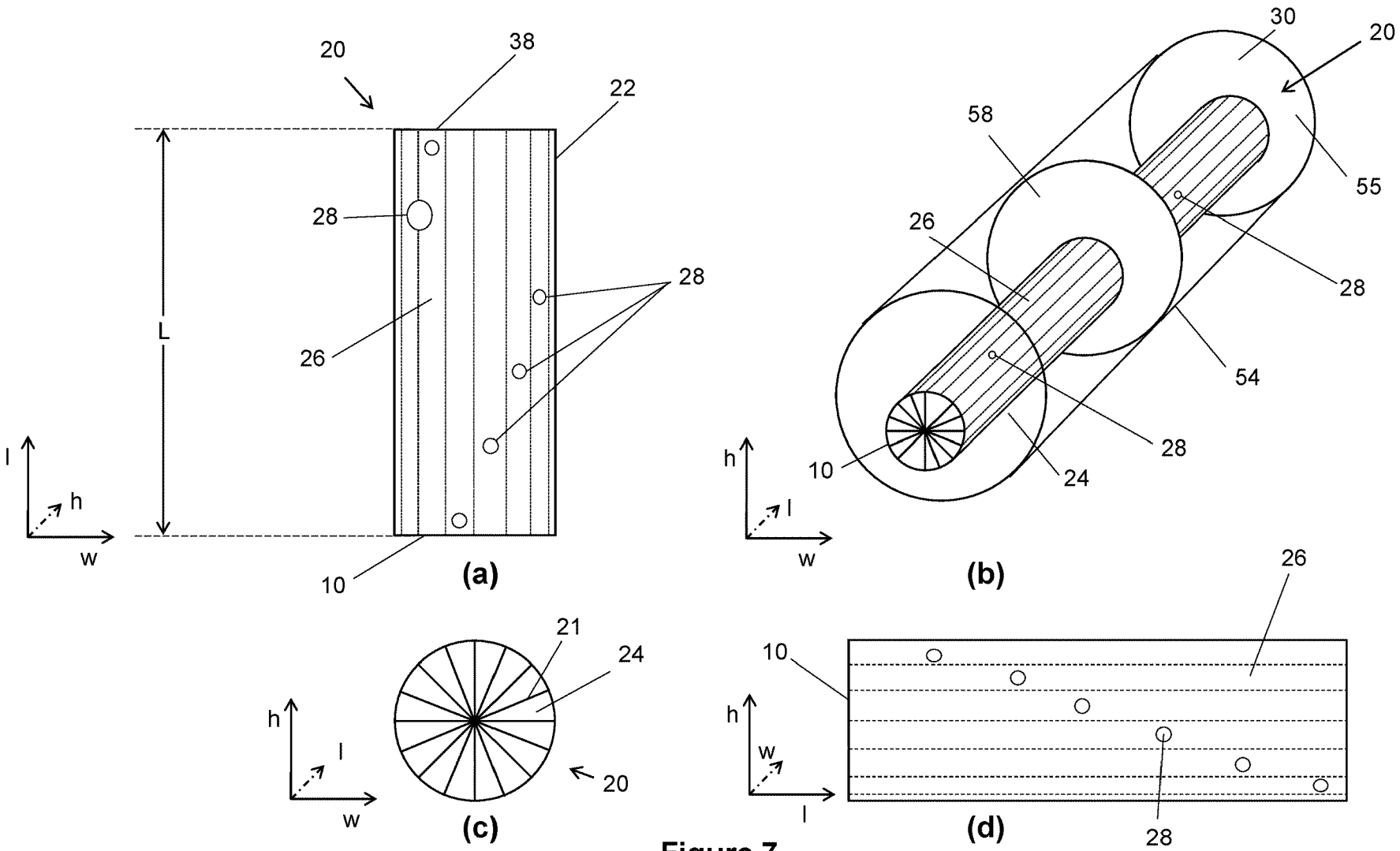
FIG. 7 is a schematic illustration of a face view (a), end view (b), side view (c) and isometric view (d) of a multiport distributor having circular cross-sectional shape.

FIG. 7 is a schematic illustration of a face view (a), isometric view (b), end view (c) and side view (d) of a multiport distributor 20 having a circular cross-sectional shape. The inlet ports 24 and corresponding fluid passages 26 can be equally spaced and equally sized about the circumference of the distributor. Alternatively, one or more of the inlet ports 24 and corresponding fluid passages 26 can have different cross-sectional shapes and/or corresponding hydraulic diameter than the remaining ones. Webs 21 can separate adjacent fluid passages 26 of the plurality of fluid passages 26. For example, the plurality of inlet ports 24 and corresponding plurality of fluid passages 26 can have pie shaped cross sections with webs 21 disposed therebetween.

A plurality of first outlet ports 28 can be disposed on a face (e.g., outer surface) of the elongated member 22. One or more first outlet ports of the plurality of first outlet ports 28 can be disposed along a single fluid passage 26 of the plurality of fluid passages 26. The one or more first outlet ports 28 can be positioned in any suitable pattern along the length of the elongated member 22. For example, the one or more first outlet ports 28 can be located in a helical pattern around the elongated member 22. The one or more first outlet ports 28 can be sized in any way. For example, the one or more first outlet ports 28 can be sized in a way that increases pressure drop along fluid flowpaths traversing the upstream end of the distributor (e.g., flowpaths traversing the distributor towards the first end 10) during operation of the heat exchanger 50. Pressure drop biasing (e.g., shifting more flow resistance toward or away from the axial inlet end 10 of the multiport distributor) can aid in achieving acceptable fluid flow distributions through all the microchannel tubes 52 of the microchannel heat exchanger 50. In at least this way the distributor can help even out the pressure drop distribution associated with conveying fluid across a larger microchannel heat exchanger core. For example, manifolds of greater than or equal to 36 inches in length, or greater than or equal to 48 inches in length, or greater than or equal to 60 inches in length.

Figure 8:
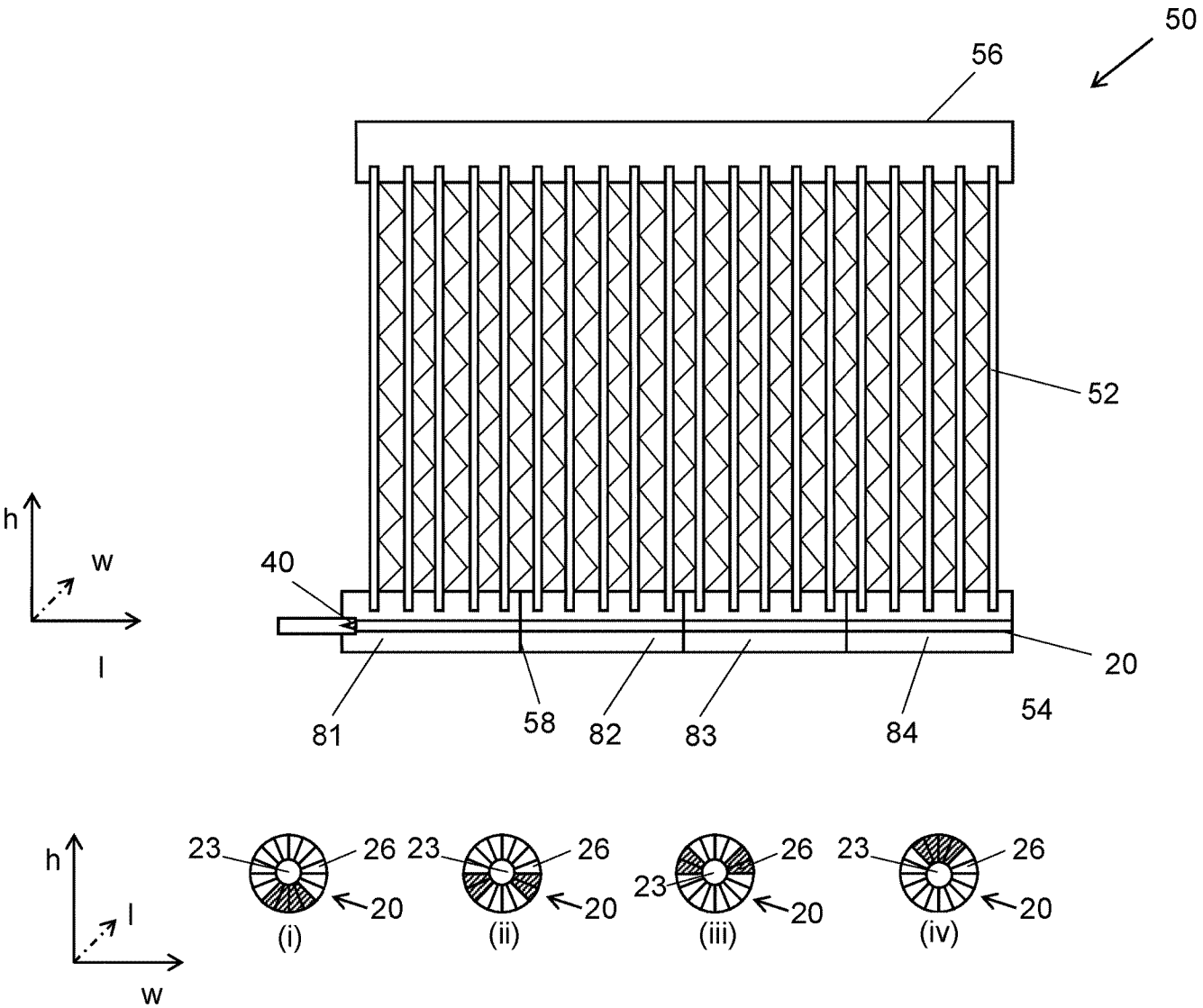
FIG. 8 is a schematic illustration of a microchannel heat exchanger having a multiport distributor with baffles disposed therein with cross-sections of the multiport distributor shown directly below the first manifold.

FIG. 8 is a schematic illustration of a microchannel heat exchanger 50 having a multiport distributor 20 having sectioning baffles 58 disposed therein, with cross-sections of the multiport distributor 20 shown below the first manifold 54. As previously described, one or more baffles 58 can be located along the length of the multiport distributor 20. The baffles 58 can be solid, preventing fluid flow, or can include flow holes therethrough, allowing for fluid to move between adjacent sections of the first manifold 54. Sectioning the first manifold 54 with solid baffles 58 can allow for each section to fluidly communicate with a selected number of the plurality of microchannel tubes 52 of the microchannel heat exchanger 50 and with a select number of first outlet ports 28 of the multiport distributor 20. For example, a baffle 58 can be placed to separate the first manifold 54 into separate sections where each section fluidly communicates with less than or equal to 20 microchannel tubes 52, or less than or equal to 16 microchannel tubes 52, or less than or equal to 12 microchannel tubes 52, or less than or equal to 10 microchannel tubes 52, or less than or equal to 8 microchannel tubes 52.

Further, the multiport distributor 20 can be configured with one or more selected first outlet ports 28 and corresponding fluid passages 26 in fluid communication with a single baffled-off section of the first manifold 54. For example, the first manifold 54 can be configured with sections 81, 82, 83, and 84, where each section is in fluid communication with selected fluid passages 26 of the multiport distributor 20. The shaded fluid passages 26 in the attached figures are intended to represent the fluid passages 26 which are fluidly coupled to each section of the first manifold 54 illustrated directly above (e.g., where FIG. 8(*i*) corresponds to the cross section of the multiport distributor 20 along section 81 of the first manifold, FIG. 8(*ii*) corresponds to section 82, and so forth). In the illustrated, non-limiting case, the first manifold 54 is sectioned into four sections, the multiport distributor is divided into 12 circumferential fluid passages 26, four of which are in fluid communication with each of the sections of the first manifold 54. In another example, the number of first outlet ports 28 can be equal to the number of separate baffled off sections of the first manifold 54.

Figure 9:
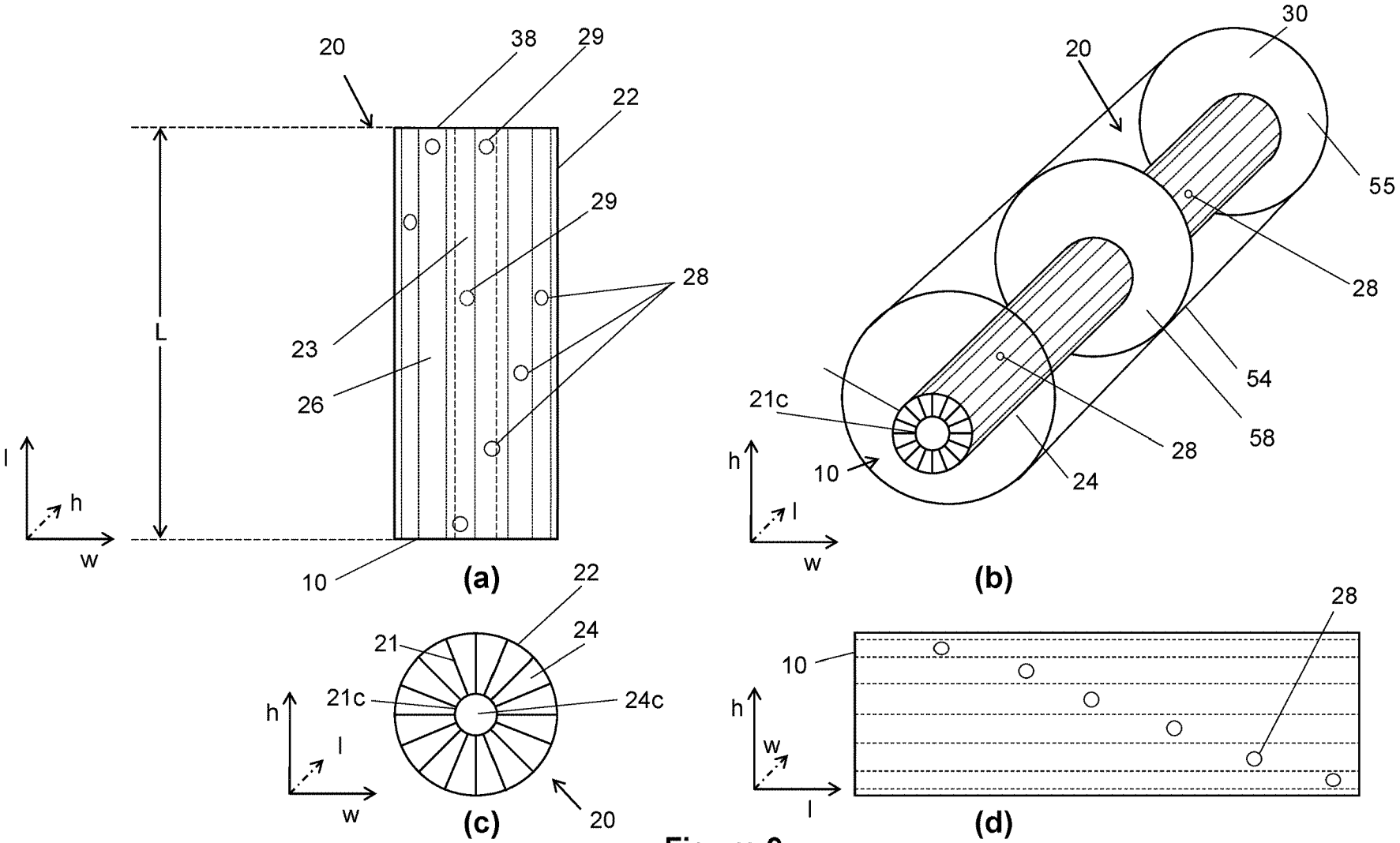
FIG. 9 is a schematic illustration of a face view (a), end view (b), side view (c) and isometric view (d) of a multiport distributor having inner fluid passage.

FIG. 9 is a schematic illustration of a face view (a), isometric view (b), end view (c) and side view (d) of a multiport distributor 20 having a circular cross-sectional shape and an inner inlet port 24*c* and corresponding inner fluid passage 23 (e.g., between long dashed lines in the attached FIG. 9*a*). The inner fluid passage 23 can be fluidly isolated from the remaining fluid passages 26 (e.g., where there is no hole in the inner web 21*c* forming the inner fluid passage 23). The inner fluid passage 23 can have any cross-sectional shape and can be positioned anywhere in the multiport distributor 20. The inner fluid passage 23 can extend along an axis which is parallel to the major axis of the elongated member 22. The inner fluid passage 23 can extend coaxially with the face (e.g., outer surface) of the multiport distributor 20.

Optionally, the inner fluid passage 23 can include one or more inner holes 29 (shown in dashed lines in the attached figures) through the inner web 21*c*, forming a fluid connection between the inner fluid passage 23 to one or more separate fluid channels 26. The inner holes 29 can be distributed along the length of the multiport distributor 20. When included, at least two inner holes 29 of the plurality of inner holes 29 can be disposed between otherwise fluidly separate fluid passages which can allow for flow through the inner fluid passage 23 in a third direction opposite the first direction (e.g., from an outlet end to an inlet end of the distributor). It is contemplated that the inner fluid passage 23 can act as a common reservoir, helping to equalize the pressure and dampen pressure fluctuations along the length L (e.g., extending in the 1-axis dimension of the attached figures) of the multiport distributor 20. For example, not to be bound by theory, the applicants contemplate that fluid can be pushed into the inner fluid passage 23 through inner holes 29 along sections of the multiport distributor 20 where the pressure is higher (e.g., first end 10, or inlet end of the distributor) while along a lower pressure section (e.g. second end 30, or outlet end of the distributor) fluid can flow out of the inner fluid passage 23, relieving pressure. In this way, it is contemplated that the inner fluid passage 23 can act as both a fluid sink (e.g., along an inlet portion) and a fluid source (e.g., along an outlet portion). This redistribution action can short circuit some fluid from the inlet end to the outlet end of the multiport distributor 20 to help more evenly distribute the entering fluid to all of the microchannel heat exchanger tubes 52 of the microchannel heat exchanger 50. The inner fluid passage 23 can also be configured with two or more inner holes 29 such that the two or more inner holes 29 and the inner fluid passage 23 can form a fluid passageway configured to convey the fluid in a third direction which can be substantially opposite the first direction.

The inner fluid passage 23 can be configured to have any number of inner holes 29 having any suitable spacing, pattern, size, and shape. For example, the inner fluid passage 23 can be configured such that each inner hole 29 aligned with one of the plurality of first outlet ports 28 disposed through the outer surface of the multiport distributor 20. The inner hole 29 can be formed in a drilling or cutting process, e.g., at the same time that first outlet ports 28 are formed in the outer surface of the multiport distributor 20. For example, following an extrusion process, a first outlet port 28 and an inner hole 29 can be sequentially drilled through the extruded multiport distributor 20. In this way, the first outlet port 28 can be formed with a flow area equal to or less than the flow area of the inner hole 29. As previously described, the web 21 (e.g., including inner web 21*c*) can be separately formed (e.g., extrusion, folding, 3D printing, and the like) and inserted into a hollow elongated member 22 to form the multiport distributor 20. In this way, inner holes 29 can be formed (e.g., through a drilling, cutting, or like operation) in the insert, prior to inserting it into the elongated member. For example, an inner hole 29 can be drilled into a piece of sheet aluminum which can be folded, bent, welded, or otherwise formed into a web structure that can be inserted into the elongated member 22.

Figure 10:
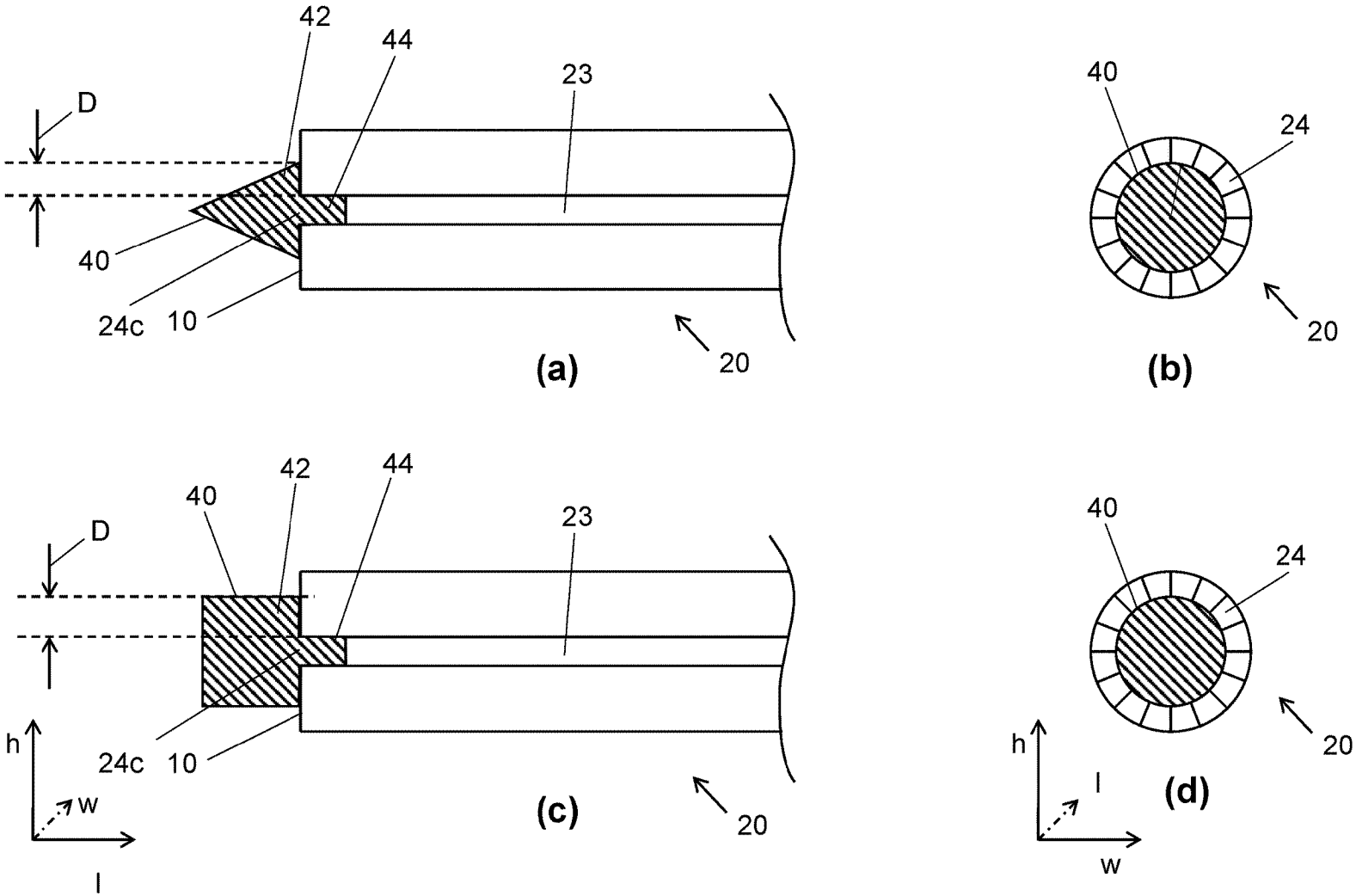
FIG. 10 is a schematic illustration of an axial cross-section (a) and a corresponding face view (b) of the multiport distributor having a conically shaped inlet distributor and an axial cross-section (c) and corresponding a face view (d) of the multiport distributor having a cylindrically shaped inlet distributor.

The multiport distributor 20 can further include an inlet distributor 40 positioned upstream of the inlet end (e.g., first end 10) of the elongated member 22. FIG. 10 is a schematic illustration of an axial cross-section (a) and a corresponding face view (b) of the multiport distributor 20 having a conically shaped inlet distributor 40 and an axial cross-section (c) and corresponding a face view (d) of the multiport distributor 20 having a cylindrically shaped inlet distributor 40. The inlet distributor 40 can be any suitable shape and size. The inlet distributor 40 can include a head 42 for directing entering fluid into the plurality of inlet ports 24. The head 42 of the inlet distributor 40 can be any shape. For example, the head 42 can be conical, cylindrical, bullet shaped, parabolic, or the like. A neck 44 can extend from the head 42 and can be configured to engage the inner fluid passage 23. In this way, the inner fluid passage 23 can act as a positioning feature for positioning an inlet distributor 40 relative to the inlet ports 24. The inner inlet port 24*c* and corresponding inner fluid passage 23 can be any suitable cross-sectional shape (e.g., such as circular, triangular, square, and the like) and can be configured to have a shape corresponding to the cross-sectional shape of the neck 44 of the inlet distributor 40. The inner inlet port 24*c* and corresponding inner fluid passage 23 can include any cross sectional shape. For example, the transverse cross-section shape of the inner port 24*c* can include circular, oval, triangular, rectangular, square a simple polygon having straight or curved sides, D-shaped or circular other than having a flat edge along a portion of the circumference, having a clocking feature such as a tab and notch engagement such that it is unable to rotate around the 1-axis dimension, or the like. The inlet distributor 40 can be affixed into a locked, non-rotating, position by welding or brazing it in place.

The inlet distributor 40 can include an overlap distance D overlapping the inlet ports 24. The head 42 can include flow channels formed along the outer surface. The flow channels can be shaped to correspond to the cross sectional shape of the web 21 such that the flow channels direct fluid into the inlet ports 24 while minimizing the overlap distance D. Adjustment of the overlap distance can allow for further tuning of the fluid distribution through the multiport distributor 40.

Figure 11:
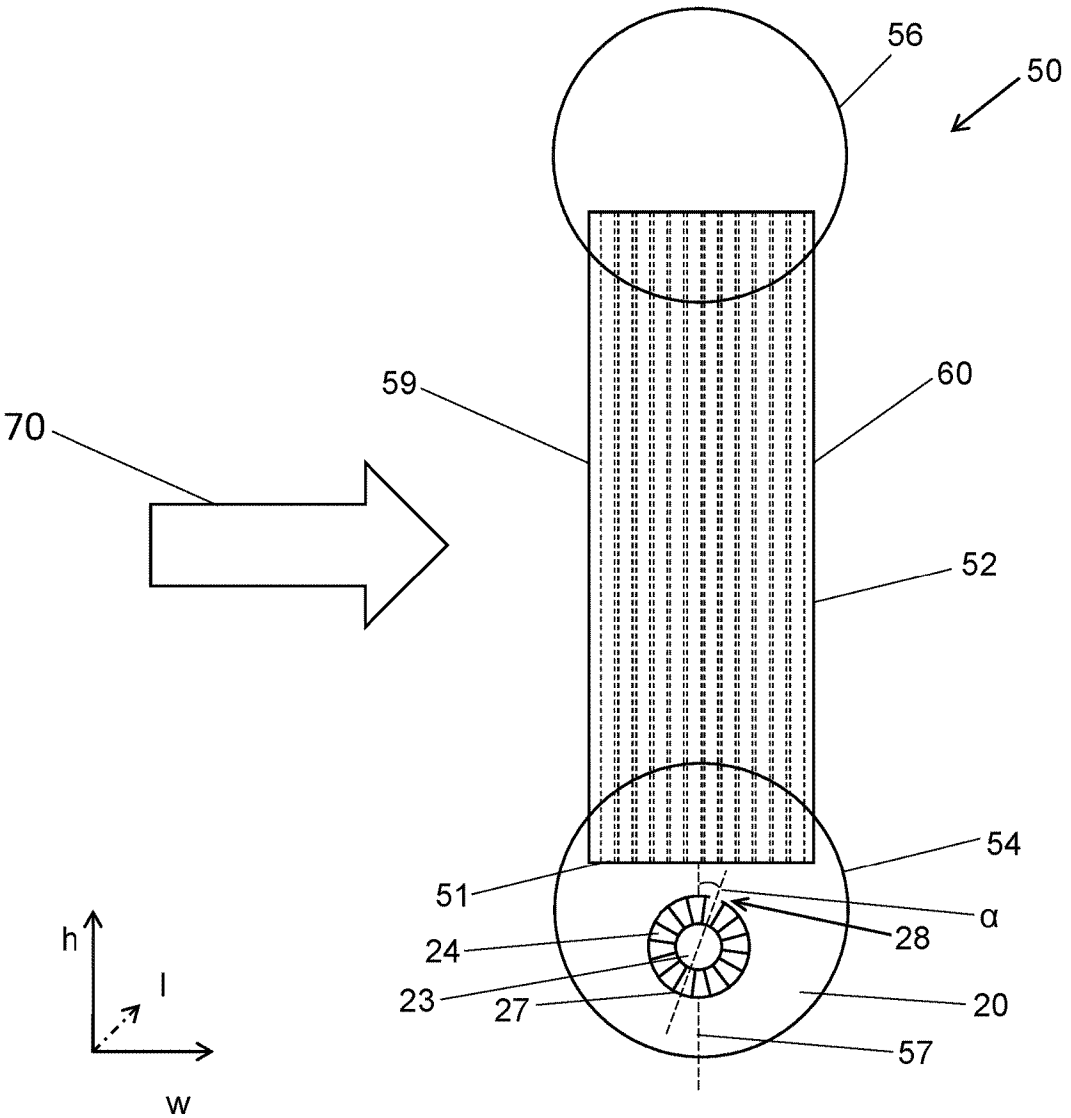
FIG. 11 is a schematic illustration of the A-A cross-section of the microchannel heat exchanger of FIG. 4.

FIG. 11 is a schematic illustration of a portion of a cross-sectional view of microchannel heat exchanger 50 taken at the location A-A in FIG. 4. Inside the first manifold 54, the multiport distributor 20 can be oriented based on an orientation angle $\alpha$ between an outlet port axis 27 of one of the first outlet ports 28 and an inlet port axis 57 of an inlet port 51 of the plurality of microchannel tubes 52 as shown in FIG. 11 (where the channels of the microchannel tubes are shown in dashed lines). The orientation angle $\alpha$ can be from 0° to 359°, or from 60° to 300°, or from 90° to 270°, or from 130° to 230°, or from 135° to 225° and can be selected based on the desired flow distribution through the plurality of microchannel tubes 52 of the microchannel heat exchanger 50. For example, the multiport distributor 20 can be configured such that the first outlet ports 28 face inlet ports 51 of the plurality microchannel tubes 52, having a 0° angle between an outlet port axis 27 of the first outlet ports 28 and an inlet port axis 57 of the inlet ports 51 of the plurality of microchannel tubes 52. The, multiport distributor 20 can be configured such that the first outlet ports 28 face directly away from inlet ports 51 of the plurality microchannel heat exchanger tubes 52, having a 180° angle between an outlet port axis 27 of the first outlet ports 28 and an inlet port axis 57 of the inlet ports of the plurality of microchannel tubes 52.

Optionally, the one or more first outlet ports 28 that are closest to the inlet end of the multiport distributor 20 (e.g. closest to the first end 10) can be configured to send flow away from the inlet ports 51 of the plurality of microchannel tubes 52 (e.g., to extend the flowpath of fluid at the inlet of the heat exchanger 50). For example, one or more first outlet ports 28 that are nearest to the inlet of the multiport distributor 20 can be positioned with an orientation angle $\alpha$ of between 90° and 270°, or 120° and 240°, or 150° and 210°, or 170° and 190°. The one or more first outlet ports 28 that are furthest away from the inlet of the multiport distributor 20 (e.g. furthest from the first end 10) can be positioned to flow more towards the inlet ports 51 of the plurality of microchannel tubes 52. For further example, the first outlet ports 28 that are furthest away from the inlet of the multiport distributor 20 can be positioned with an orientation angle $\alpha$ of between 0° to 90° or 270° to 359°, or of between 0° to 60° or 300° to 359°, or of between 0° to 30° or 300° to 359°.

Figure 12:
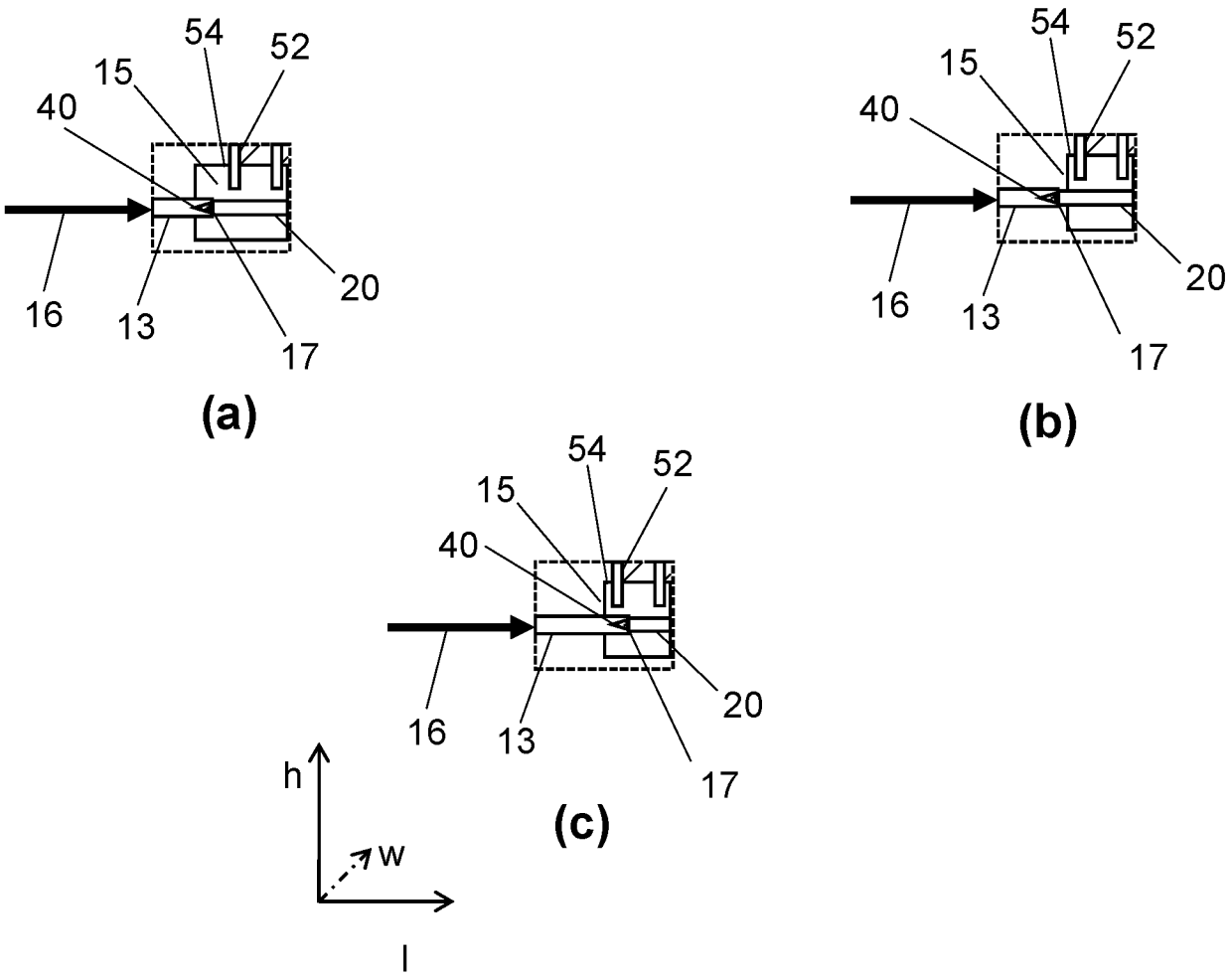
FIG. 12 is a schematic illustration of detail B of the microchannel heat exchanger of FIG. 4.

FIG. 12 is a schematic illustration of detail B of FIG. 4, where an inlet 16 (e.g., carrying liquid phase refrigerant, two phase vapor-liquid refrigerant, and the like) is fluidly connected to the multiport distributor 20 at the first manifold 54. As shown in FIG. 12*a*, the inlet 16 can be fluidly connected to the multiport distributor 20 by an inlet fluid connection 13 extending into the first manifold 54 and engaging the multiport distributor 20. Sealing such a connection can be done during a brazing operation. For example, brazing at the same time that the heat exchanger Alternative methods of connecting the inlet 16 to the multiport distributor 20 include joining the plurality of inlet ports 24 of the multiport distributor 20 to the inlet fluid connection 13 outside of the first manifold 54 as shown in FIG. 12*b*. The location of the joint between the inlet fluid connection 13 and the multiport distributor 20 can be inboard from the manifold end wall. For example, the joint 17 between the inlet fluid connection 13 and the multiport distributor 20 can be formed in-board of one or more microchannel tubes 52 as shown in FIG. 12*c*.

The disclosed multiport distributor 20 can be utilized in conjunction with any heat exchanger having an inlet manifold and a plurality of internal flow passages extending therefrom. For example, as in the embodiments described above a microchannel heat exchanger can utilize the presently disclosed multiport distributor 20. In another example, a brazed plate heat exchanger (BPHE) can utilize the multiport distributor 20 to affect the distribution between the plates of the BPHE. A brazed plate heat exchanger can include multiple plates stacked together to form a core. The plates can include corrugation, folding, embossing, or other surface contouring, such that when stacked, substantially parallel flow channels are formed between the plates. The plates of the core can further include holes therethrough. The holes of the plurality of plates can be aligned in the stack to form two or more manifolds extending perpendicular to the fluid flow path through the core. The manifolds allow for fluid to be introduced and removed from the flow channels extending between the plates. The BPHE can include four manifolds disposed therein, allowing for two separate fluids to flow through the core between adjacent pairs of plates. In such an embodiment, the plates pairs are configured to allow flow between only two of the manifolds (an inlet and an outlet). For example, the BPHE can be stacked such that a first inlet manifold and a first outlet manifold interact with a first plurality of flow passages between first plate pairs, and a second inlet manifold and a second outlet manifold are disposed in fluid communication with a second plurality of flow passages between second plate pairs, where flow passages of the first plate pairs are disposed adjacent to flow passages of the second plate pairs. As with the microchannel heat exchanger, the multiport distributor 20 can be configured within an inlet manifold of a BPHE to improve the distribution (e.g., balance the flow) of fluid to the plurality of channels disposed between the plates.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A multiport distributor comprising:

an elongated member comprising;

a plurality of inlet ports disposed along a first end of the elongated member, a plurality of first outlet ports disposed along a face of the elongated member, and a plurality of fluid passages disposed within the elongated member and extending between the plurality of inlet ports and the plurality of first outlet ports, wherein the plurality of fluid passages are substantially parallel to one another and configured to convey a fluid in a first direction, wherein the plurality of first outlet ports are configured to direct the fluid passing therethrough in a second direction, wherein the second direction is substantially perpendicular to the first direction.

2. The multiport distributor of claim 1, wherein the elongated member comprises a flat tube and the plurality of fluid passages are arranged in a single row within the flat tube.

3. The multiport distributor of claim 1, further comprising an inner fluid passage.

4. The multiport distributor as in any preceding claim, further comprising an inlet distributor configured to guide the fluid flowing in the first direction into the plurality of inlet ports of the multiport distributor.

5. The multiport distributor of 3, further comprising an inlet distributor configured to guide the fluid flowing in the first direction into the plurality of inlet ports of the multiport distributor, wherein the inlet distributor comprises a neck, and wherein the neck is configured to slidable fit into the inner fluid passage.

6. The multiport distributor of claim 3, further comprising an inner hole disposed in a wall of the inner fluid passage.

7. The multiport distributor of claim 3, further comprising two or more inner holes disposed in a wall of the inner fluid passage, the two or more inner holes and the inner fluid passage forming a fluid passageway configured to convey the fluid in a third direction, and wherein the third direction is substantially opposite the first direction.

8. The multiport distributor of claim 3, further comprising a plurality of inner holes disposed in a wall of the inner fluid passage along a length of the multiport distributor, wherein at least two inner holes of the plurality of inner holes are in fluid communication with otherwise fluidly separate fluid passages, and wherein the at least two inner holes and the inner fluid passage form a fluid passageway configured to convey the fluid in a third direction, and wherein the third direction is substantially opposite the first direction.

9. The multiport distributor of claim 1, wherein one or more passages of the plurality of fluid passages comprises a cross-sectional flow area that is greater than the cross sectional flow area of the remaining passages.

10. The multiport distributor of claim 1, wherein two or more of the plurality of first outlet ports are disposed in fluid communication with one of the plurality of fluid passages.

11. The multiport distributor of claim 1, wherein the number of outlet ports in the plurality of first outlet ports is greater than the number of inlet ports in the plurality of inlet ports.

12. The multiport distributor of claim 1, wherein one of the first outlet ports is disposed in fluid communication with two or more of the plurality of fluid passages.

13. The multiport distributor of claim 1, wherein the number of outlet ports in the plurality of first outlet ports is less than the number of inlet ports in the plurality of inlet ports.

14. The multiport distributor of claim 1, wherein one or more outlet ports of the plurality of outlet ports comprises a hydraulic diameter that is greater than the hydraulic diameter of the remaining outlet ports.

15. The multiport distributor of claim 1, wherein an outlet port of the plurality of first outlet ports is disposed in fluid communication through the elongated member with only one inlet port of the plurality of inlet ports and only one fluid passage of the plurality of fluid passages, and wherein the outlet port, the fluid passage, and the inlet port all each comprise a hydraulic diameter that is substantially equal.

16. The multiport distributor of claim 1, further comprising a plurality of second outlet ports disposed along an end opposite the first end of the elongated member, wherein the plurality of second outlet ports are substantially obstructed to substantially reduce the ability for fluid to flow therethrough.

17. The multiport distributor of claim 1, wherein the elongated member comprises an extruded multiport tube.

18. A microchannel heat exchanger comprising a first manifold, a second manifold and a plurality of microchannel tubes extending between the first manifold and the second manifold, and the multiport distributor of claim 1, wherein the multiport distributor is disposed in the first manifold of the microchannel heat exchanger and is configured to distribute a flow of a first heat transfer fluid to the plurality of microchannel tubes.

19. The microchannel heat exchanger of claim 18, further comprising a separator plate disposed within the first manifold surrounding the multiport distributor and sealed against the first manifold internal walls, wherein the separator plate divides the first manifold internal volume into two volumes.

20. The microchannel heat exchanger of claim 19, wherein the two volumes comprise a multiport distributor inlet header volume and a microchannel tube inlet header volume, and wherein the multiport distributor inlet header volume is smaller than the microchannel tube inlet header volume.

21. The microchannel heat exchanger of claim 20, further comprising a conduit in fluid communication with the plurality of the inlet ports of the multiport distributor wherein a first flow direction through the conduit is oriented perpendicular to a flow direction through the plurality of inlet ports of the multiport distributor.

22. The microchannel heat exchanger of any of claim 18, wherein the first heat transfer fluid comprises a refrigerant.

23. The microchannel heat exchanger of any of claim 18, wherein the first heat transfer fluid comprises a liquid.

24. The microchannel heat exchanger of any of claim 18, wherein the multiport distributor is oriented within the first manifold having an orientation angle between an axis of the first outlet ports and an axis of an inlet port of the plurality of microchannel tubes of between 130° and 230°.

25. The multiport distributor of any of claim 18, wherein the plurality of microchannel tubes of the microchannel heat exchanger further comprise a bend to form a V shaped heat exchanger core.

26. A vapor compression system comprising the microchannel heat exchanger of claim 18.

27. A brazed plate heat exchanger comprising:

a plurality of stacked contoured plates forming a plurality of flow passages disposed therebetween, each plate comprising a first opening therethrough, wherein the first openings of the plurality of stacked contoured plates are aligned to form a first manifold, and the multiport distributor of claim 1, wherein the multiport distributor is disposed in the first manifold of the brazed plate heat exchanger and is configured to distribute a flow of a first heat transfer fluid to the plurality of flow passages.

* * * * *